US006296529B2

(12) United States Patent
Tanigawa

(10) Patent No.: US 6,296,529 B2
(45) Date of Patent: Oct. 2, 2001

(54) BULB SOCKET AND CONNECTION CONSTRUCTION OF WIRE

(75) Inventor: Fumiyoshi Tanigawa, Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 09/738,775

(22) Filed: Dec. 18, 2000

Related U.S. Application Data

(63) Continuation of application No. 09/241,605, filed on Feb. 2, 1999, now abandoned.

(30) Foreign Application Priority Data

Feb. 25, 1998 (JP) ..... 10-044002
Jun. 26, 1998 (JP) ..... 10-181093

(51) Int. Cl.[7] ..... H01R 24/00
(52) U.S. Cl. ..... 439/699.2; 439/57
(58) Field of Search ..... 439/699.2, 356, 439/36, 56, 336, 360, 375, 414, 419, 541, 558, 802, 57, 58, 546, 547, 930

(56) References Cited

U.S. PATENT DOCUMENTS

| | | | | |
|---|---|---|---|---|
| 3,050,705 | * | 8/1962 | Benson | 439/57 |
| 3,368,184 | | 2/1968 | Braun | 439/77 |
| 3,397,379 | * | 8/1968 | Puig | 439/414 |
| 3,407,377 | | 10/1968 | Anderson | 439/456 |
| 3,576,516 | | 4/1971 | Mull | 439/342 |
| 4,076,358 | * | 2/1978 | Taormina et al. | 439/547 |
| 4,193,653 | | 3/1980 | Aizawa | 439/57 |
| 4,299,430 | * | 11/1981 | Baba et al. | 439/57 |
| 4,468,585 | | 8/1984 | Beyland et al. | 313/318 |
| 4,593,958 | | 6/1986 | Baba | 439/340 |
| 5,015,197 | | 5/1991 | Redmond et al. | 439/329 |
| 5,397,251 | | 3/1995 | Kaminski | 439/620 |
| 5,622,425 | | 4/1997 | Lin | 362/249 |
| 5,890,912 | * | 4/1999 | Jenkins | 439/57 |

FOREIGN PATENT DOCUMENTS

| | | |
|---|---|---|
| 1434051 | 4/1976 | (GB) . |
| 9-231814 | 9/1997 | (JP) . |

* cited by examiner

*Primary Examiner*—Gary Paumen
*Assistant Examiner*—Ross Gushi
(74) *Attorney, Agent, or Firm*—Banner & Witcoff, Ltd.

(57) ABSTRACT

A plastic covering 32 of an electric wire 30 is removed, exposing a core wire 31, this core wire 31 being attached to core wire receiving members 13 of a lamp body 10. Attaching a bulb socket 20 to the lamp body 10 causes the core wire to be resiliently held between contact members 24D of the bulb socket 20 and the core wire receiving members 13, thereby connecting the bulb socket 20 and the electric wire 30. The core wire 31 makes direct contact with the contact members 24D, and therefore connecting terminals are not required between the bulb socket 20 and the electric wire 30, the number of components is thus decreased.

11 Claims, 8 Drawing Sheets

BULB SOCKET AND CONNECTION CONSTRUCTION OF WIRE

This application is a continuation of 09,241,605 field Feb. 2, 1999 now abandoned.

TECHNICAL FIELD

The present invention relates to a connecting structure for an electrical bulb socket and an electric wire.

BACKGROUND OF THE INVENTION

A rear combination lamp of an automobile typically has a plate-shaped body, a plurality of bulb sockets attached to the body, and electric wires connected to the bulb sockets and distributed on the body. A prior connecting means for the bulb sockets and the electric wires, as described in JP-9-231814, has connecting terminals attached to the body, and electric wires attached to the connecting terminals by pressure welding or other means. Contact members of the bulb socket make contact with the connecting terminals when the bulb sockets are attached to the body.

The conventional connecting structure requires connecting terminals between the electric wires and the bulb sockets. As a result, the number of components is large, and several attachment processes must be performed.

The present invention has been developed after taking the above problem into consideration, and aims to provide a connecting structure with fewer components.

SUMMARY OF THE INVENTION

According to the invention there is provided an electrical connecting structure comprising a body, an insulated electric wire for said body, and a bulb socket for attachment to said body and having an electrical contact, a portion of the insulation of said wire being absent, and said portion being adapted for direct contact with said electrical contact on attachment of said socket to said body. The main advantage of the invention is that intermediate terminal structure is avoided; cost is thereby reduced and furthermore the invention permits miniaturisation.

Preferably direct contact is made in the direction of attachment of the bulb socket, typically by insertion of the socket through an aperture in the body.

Preferably direct contact is made in the direction of attachment of the bulb socket, typically by insertion of the socket through an aperture in the body.

The non-insulated portion is preferably guided, for example by a channel, or being wound around a projection.

Snap-fitting means may be provided to grip the wire, preferably by indenting an insulated portion thereof, for example an insulated portion on both sides of the non-insulated portion.

BRIEF DESCRIPTION OF DRAWINGS

Other aspects of the invention will be apparent from the following description of a preferred embodiment shown by way of example only in the accompanying drawings in which.

DESCRIPTION OF PREFERRED EMBODIMENT

Figure 1:
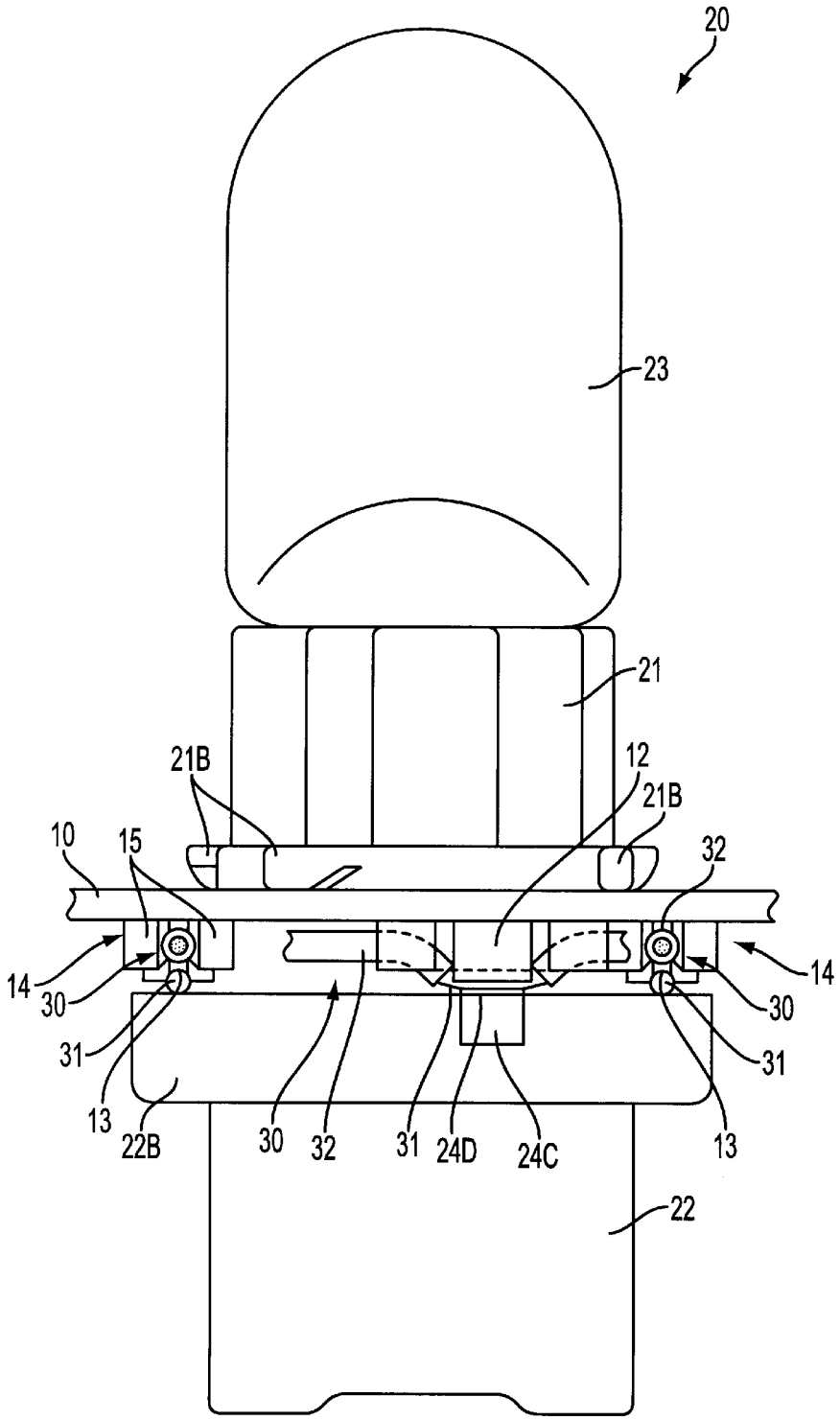
FIG. 1 is a plan view of a first embodiment showing a lamp body and a bulb socket in an attached state.
Figure 2:
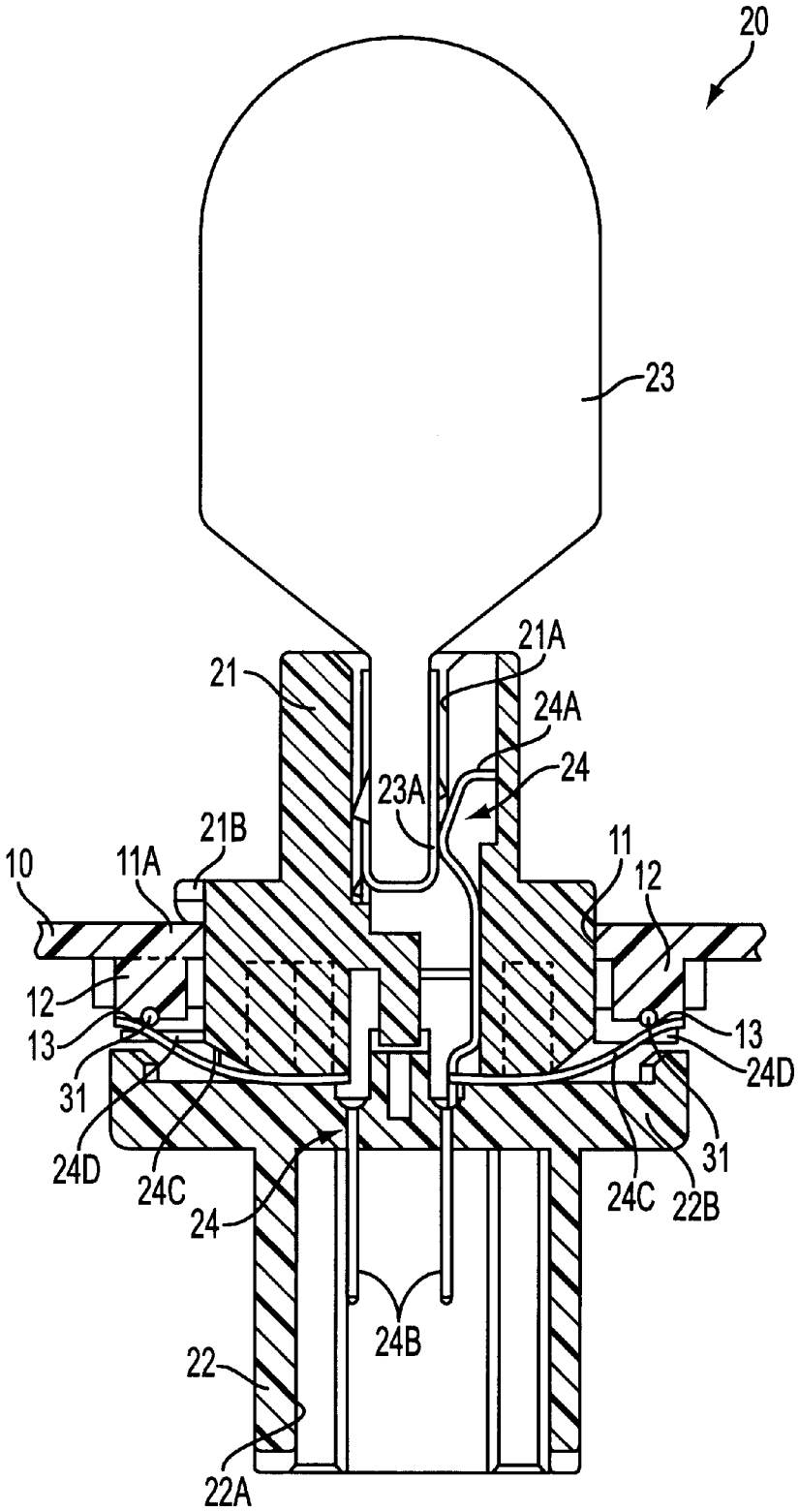
FIG. 2 is a cross-sectional view of FIG. 1 turned through 90°.
Figure 3:
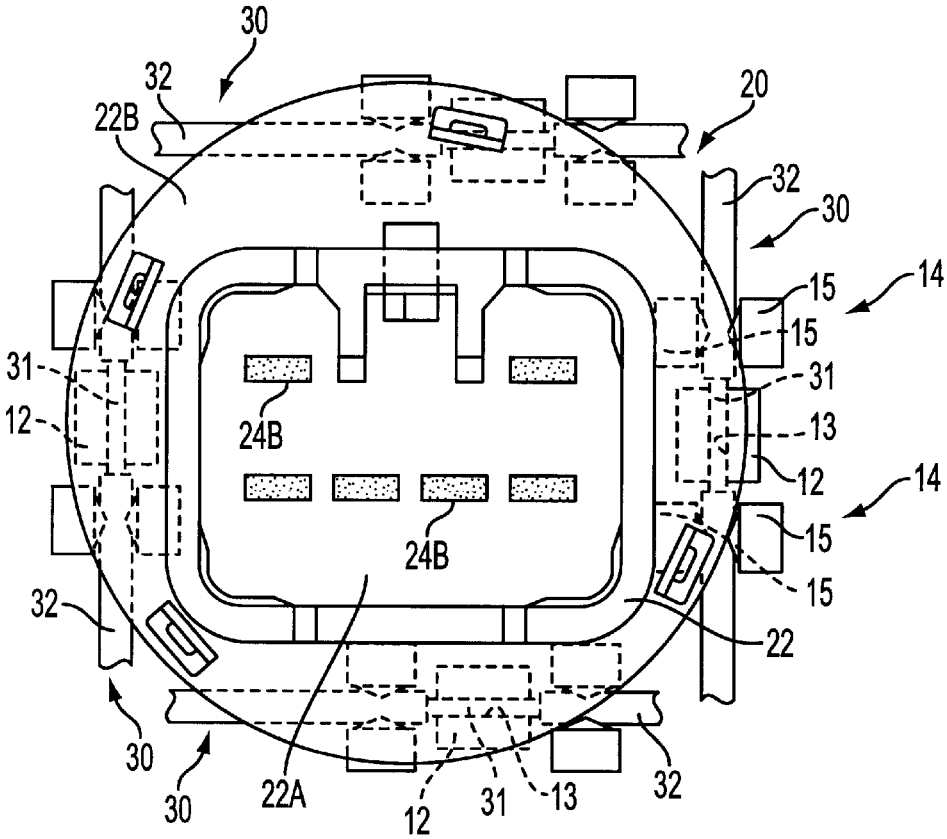
FIG. 3 is a rear view showing the lamp body and the bulb socket in the attached state.
Figure 4:
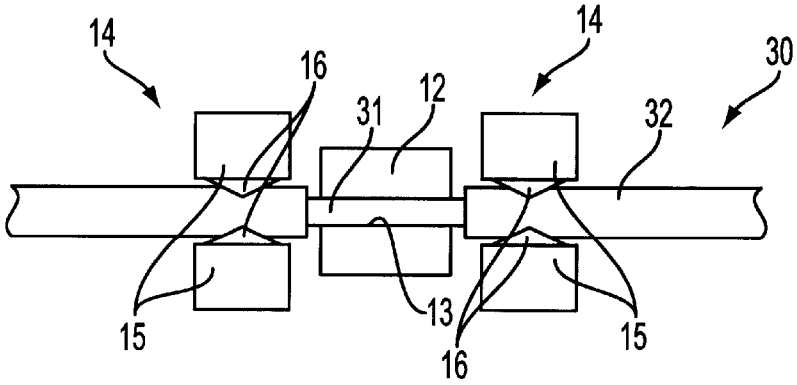
FIG. 4 is a partial, enlarged rear face view showing an electric wire supported by a core wire receiving member and a supporting member.
Figure 5:
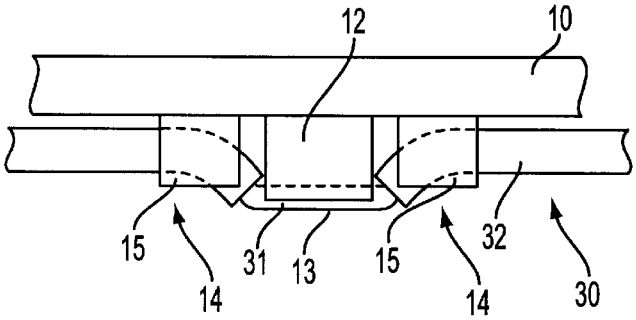
FIG. 5 is a partial, enlarged plan view showing the electric wire being supported by the core wire receiving member and the supporting member.
Figure 6:
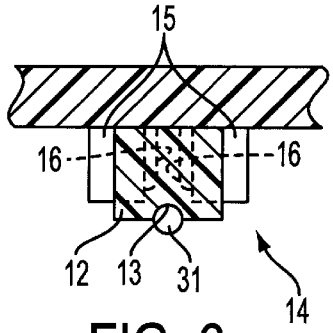
FIG. 6 is a partial, enlarged cross-sectional view showing the electric wire being supported by the core wire receiving member and the supporting member.
Figure 7:
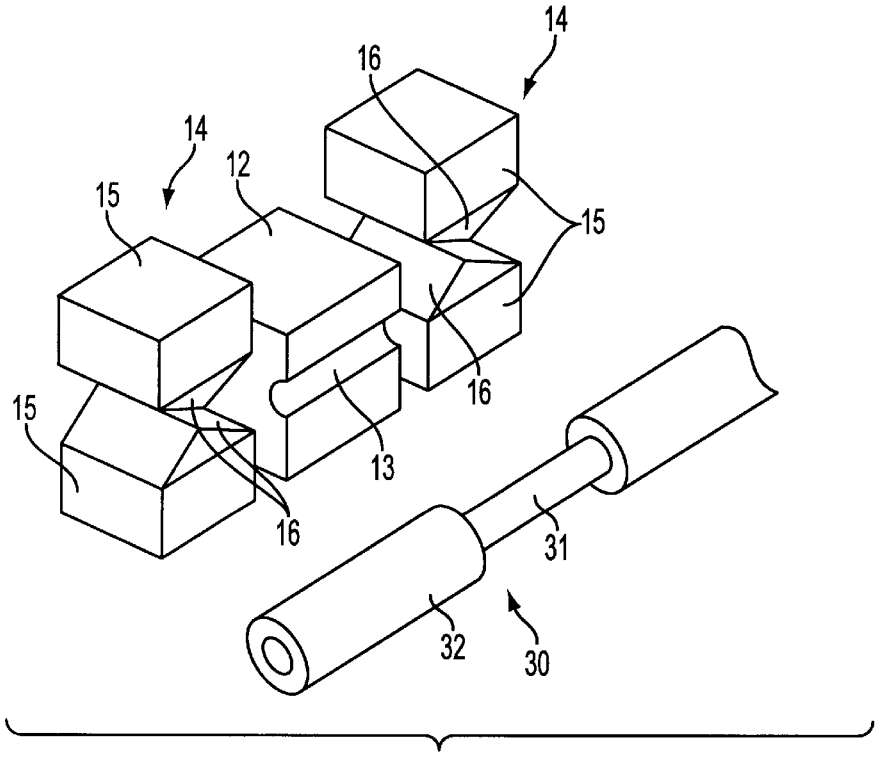
FIG. 7 is a partial, enlarged diagonal view showing the electric wire separated from the core wire receiving member and the supporting member.

A first embodiment of the present invention is explained below with the aid of FIGS. 1 to 7.

A lamp body 10 of a rear combination lamp of an automobile is of plastic and plate like. Circular attachment holes 11 are provided on a plurality of prescribed locations on the lamp body 10 (only one location is shown in the present embodiment), a bulb socket 20 being inserted in the attachment hole 11 from the exterior. Four electric wires 30 are distributed along the edges of the attachment hole 11 on a posterior face of the lamp body 10 (the lower face in FIG. 1, and the face shown in FIG. 3). When the bulb socket 20 is attached, contact members 24D thereof and core wires 31 of the electric wires 30 make contact and an electrically conductive state is achieved.

The electric wire 30 comprises a core wire 30 made from separate metal filaments and covered with a plastic covering 32. A prescribed length of the plastic covering 32 is removed, this length corresponding to a core wire receiving member 13, to be described later. The core wire 31 is thus in an exposed state, and this exposed core wire 31 makes contact with the contact members 24D of the bulb socket 20.

The bulb socket 20 comprises a plastic supporting member 21, a plastic fitting member 22 which fits together with a posterior portion of the supporting member 21, a bulb 23 with a wedge base, and a plurality of terminal fittings 24. The anterior end of the supporting member 21 has a recess 21A for receiving and supporting the bulb 23, and a resilient contact 24A of the terminal fitting 24 is adjacent to the recess 21A. A contact foot member 23A of the bulb 23 makes contact with the resilient contact 24A when the bulb 23 is attached. A stopping protrusion 21B is formed on the outer circumference of the supporting member 21, this stopping protrusion 21B being passed through a recess 11A formed on the edge of the attachment hole 11. When the bulb socket is attached, the stopping protrusion 21B fits together with the edge of the attachment hole 11 and is thereby retained in the manner of a bayonet fitting.

The terminal fitting 24 has tabs 24B which protrude towards the side opposite to the resilient contact 24A, protruding into a fitting cylinder 22A of the fitting member 22. Electric wire contact members 24C extend from the base ends of the tabs 24B towards the outer circumference along the anterior faces of flanges 22B of the fitting member 22. The protruding ends of these electric wire contact members 24C bend in an anterior direction, and are resiliently bendible in an anterior-posterior direction. When the bulb socket 20 is in an attached state, the resilient recovery force of the electric wire contact members 24C presses the stopping protrusion 21B against the edge of the attachment hole 11, thereby maintaining the bulb socket 20 in a state whereby its movement in an anterior-posterior direction is regulated with respect to the lamp body 10.

A total of four electric wire contact members 24C are provided. Their protruding end portions, which protrude towards the outer circumference of the flange 22B and make contact with the electric wire 30, constitute members 24D. These contact members 24D are provided at a pitch of 90° in the circumferential direction.

Four ribs 12 protrude from a posterior face of the lamp body 10, the ribs 12 protruding at a location slightly separated from the edge of the attachment hole 11. These four ribs 12, are provided at a 90° pitch along a circular path concentric with the attachment hole 11, corresponding to the contact members 24D. Each rib 12 is cube-like. The core wire receiving members 13 are formed in the protruding end faces (the posterior end faces) of these ribs 12. These core wire receiving members 13 have a cross-sectionally semi-circular groove shape which is substantially parallel to the direction of the edge of the attachment hole 11. The diameter of this groove is approximately the same as the diameter of the core wire 31 and the posterior semi-circle of the core wire 31 protrudes from the posterior side face of the ribs 12 when the core wire 31 is attached to the core wire receiving members 13. Supporting members 14 also protrude from the posterior face of the lamp body 10, these supporting members 14 being located on both sides of the core wire receiving member 13 along the direction in which the electric wire extends. Each supporting member 14 comprises a pair of mutually opposing protrusions 15 which clamp a portion of the plastic covering 32 of the electric wire 30. The opposing faces of the two protrusions 15 are cut away in a wedge-shape, forming protruding indenting members 16. The space between these indenting members 16 is slightly smaller than the external diameter of the plastic covering 32. As a result, when the electric wire is clamped by the supporting members 14, the indenting members 16 indent or cut into the plastic covering 32, thereby regulating its movement in the direction of the wire's axis (the direction of the wire's extension).

The operation of the present embodiment is as follows.

Before the bulb socket 20 is attached, each electric wire 30 is positioned along a prescribed route, the exposed core wire 31 is attached to the core wire receiving member 13, and both sides of a section of the plastic covering 32 are fitted with and maintained in position by the supporting members 14. Each electric wire 30 is thereby positioned along a prescribed route, and the respective core wire 31 is maintained in a position in which it can make contact with the contact members 24D.

From this state the stopping protrusion 21B is passed through the recess 11A, the bulb socket 20 is passed through the attachment hole 11 from the posterior face side of the lamp body 10, and the contact members 24D at the tips of the electric wire contact members 24C make resilient contact with the posterior end faces of the supporting members 14. From this state, the entire bulb socket 20 is rotated to a prescribed position, the stopping protrusion 21B is pressed in by the resilient recovery force of the electric wire contact members 24C and fits with the posterior end section of the attachment hole 11, the bulb socket 20 being thereby held in position. In this manner, the bulb socket 20 is attached to the lamp body 10.

As the bulb socket 20 is being rotated, the contact members 24D, which were making resilient contact with the posterior end faces of the supporting members 14, move from the supporting members 14 to the core wire 31 via the plastic covering 32 of the electric wire 30, halting in a position against the core wire receiving member 13. As a result, the core wire 31 is resiliently held between the core wire receiving member 13 and the contact members 24D due to the resilient recovery force of the electric wire contact members 24C.

In this state, the core wires 31 and the contact members 24D are in electrical contact and have a prescribed amount of pressure contact.

The contact members 24D of the bulb socket 20 make direct contact with the respective core wire 31 of the electric wire 30. As a result, there is no need for connecting terminals to intervene between the bulb socket and the electric wire, as in the prior example, and the number of components is thus reduced.

Further, the contact between the core wires 31 and the contact members 24D is in the form of direct contact in the direction of attachment (the anterior-posterior direction) of the bulb socket 20. Consequently, less space is required for contact than when the core wire is positioned further towards the external circumference of the contact members.

Moreover, the core wire 31 is attached to the groove-shaped core wire receiving members 13. As a result, the core wire 31 is kept in position when the bulb socket 20 is to be attached, and a reliable connection with the contact members 24D can thus be achieved.

Further, when the bulb socket 20 is in a connected state with the core wire 31 and the contact members 24D, the direction of resilient contact of the contact members 24D is oblique relative to the anterior-posterior direction of the core wire 31. However, the core wire 31 is fitted within the core wire receiving members 13, thereby regulating the sideways movement of the core wire 31 and maintaining a stable connection.

Furthermore, both sides of the plastic covering 32 of the core wire 31 are held by the supporting members 14, thereby regulating the movement of the core wire 31 in the direction of both its axis and its diameter. As a result, the core wire 31 is maintained in a fixed position relative to the core wire receiving members 13 and, consequently, the connection between the core wire 31 and the contact members 24D is stable, In addition, the indenting members 16 of the supporting members 14 cut into the plastic covering 32 of the electric wire 30, thereby regulating the movement of the electric wire 30 in the wire's axial direction. As a result, even if a pulling force is exerted on the electric wire 30 in an axial direction, the contact position of the core wire 31 and the contact members 24D located above the core wire receiving members 13 can reliably be maintained.

Figure 8:
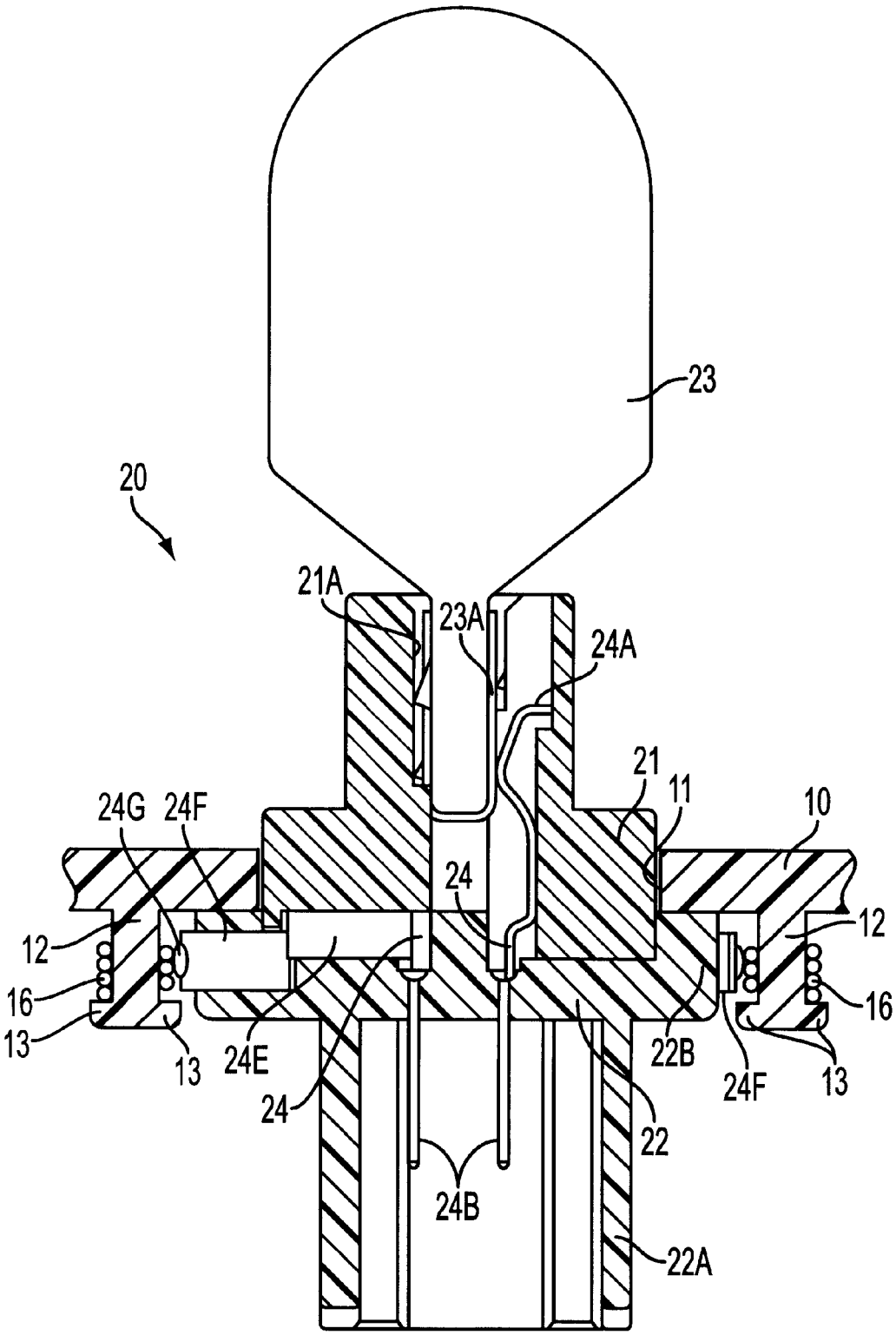
FIG. 8 is a cross-sectional view of a second embodiment.
Figure 9:
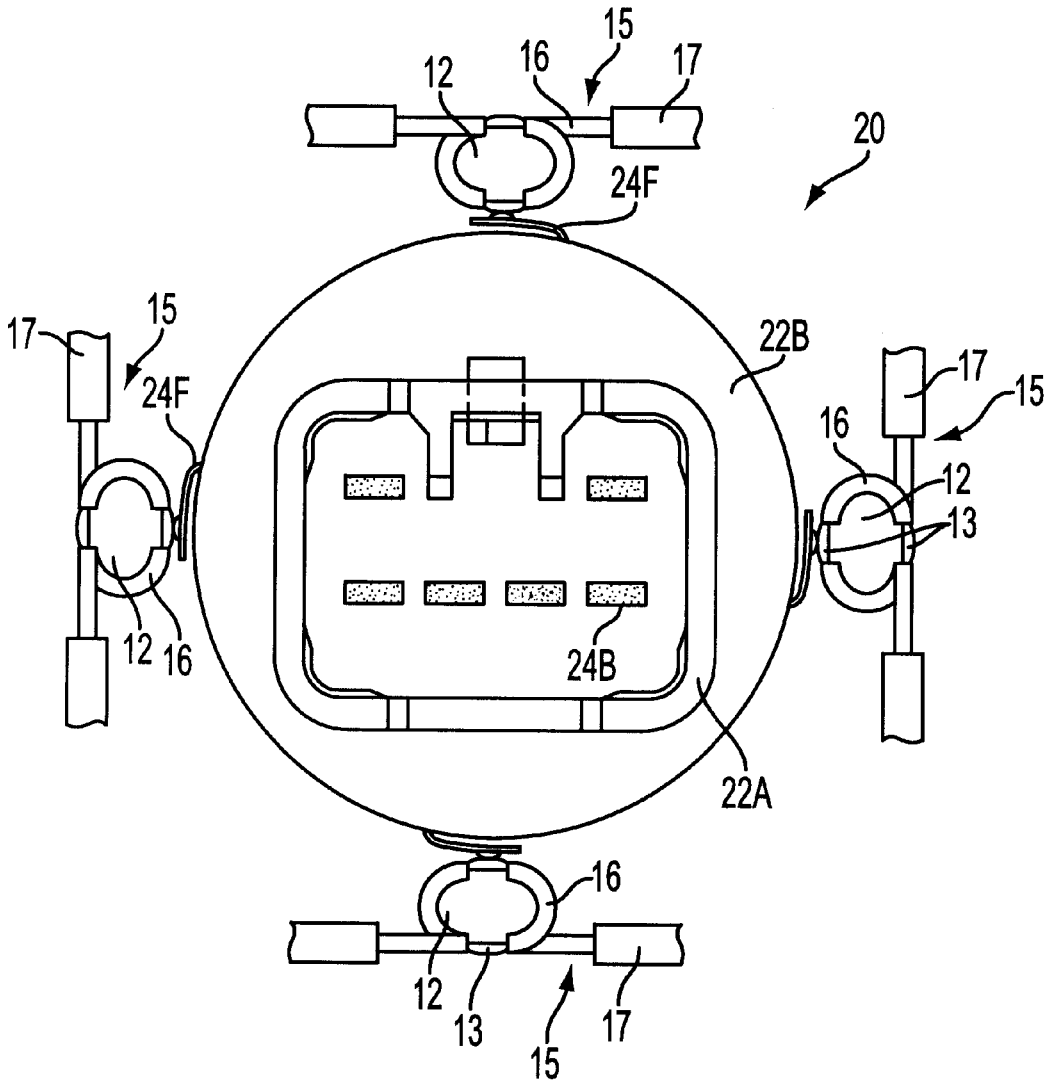
FIG. 9 is a rear face view of the embodiment of FIG. 8.
Figure 10:
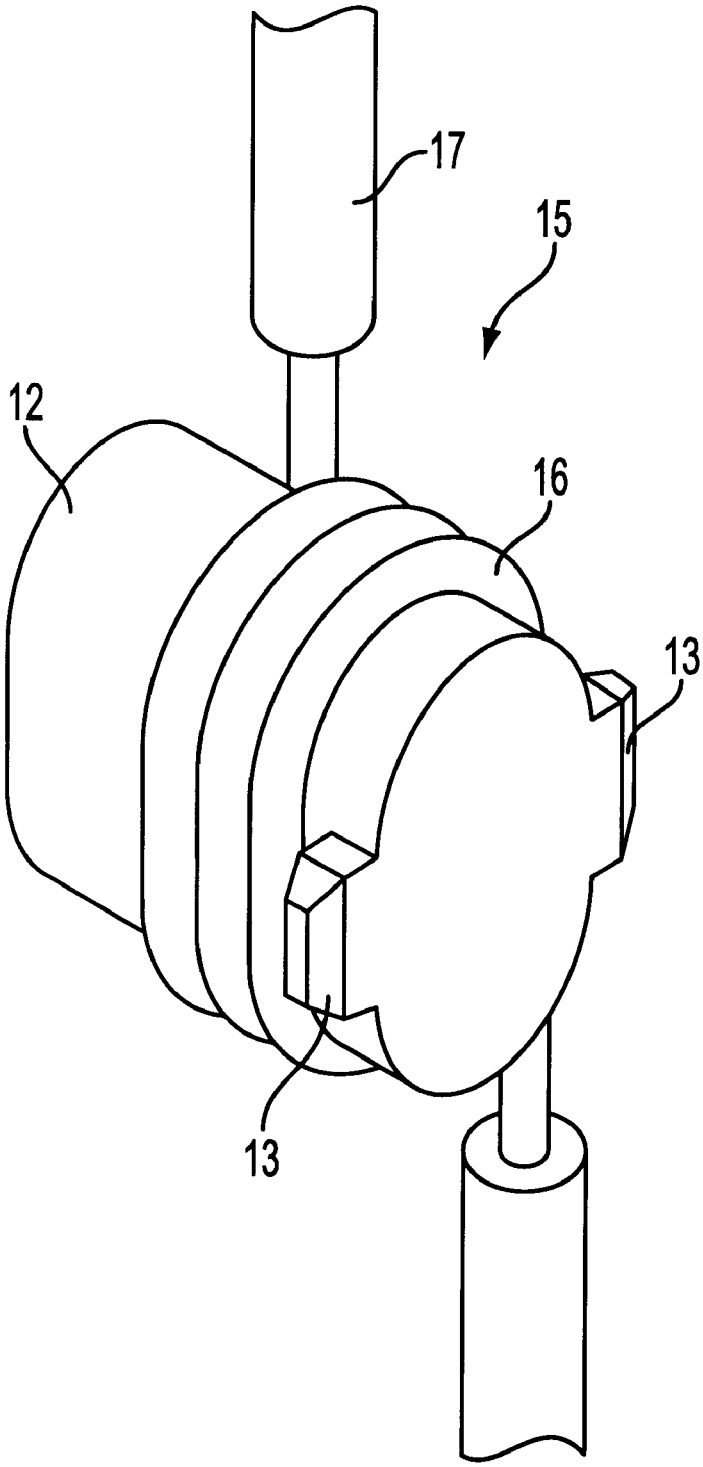
FIG. 10 is a partial enlarged view of the embodiment of FIG. 8 showing a core wire wound around a rib.
Figure 11:
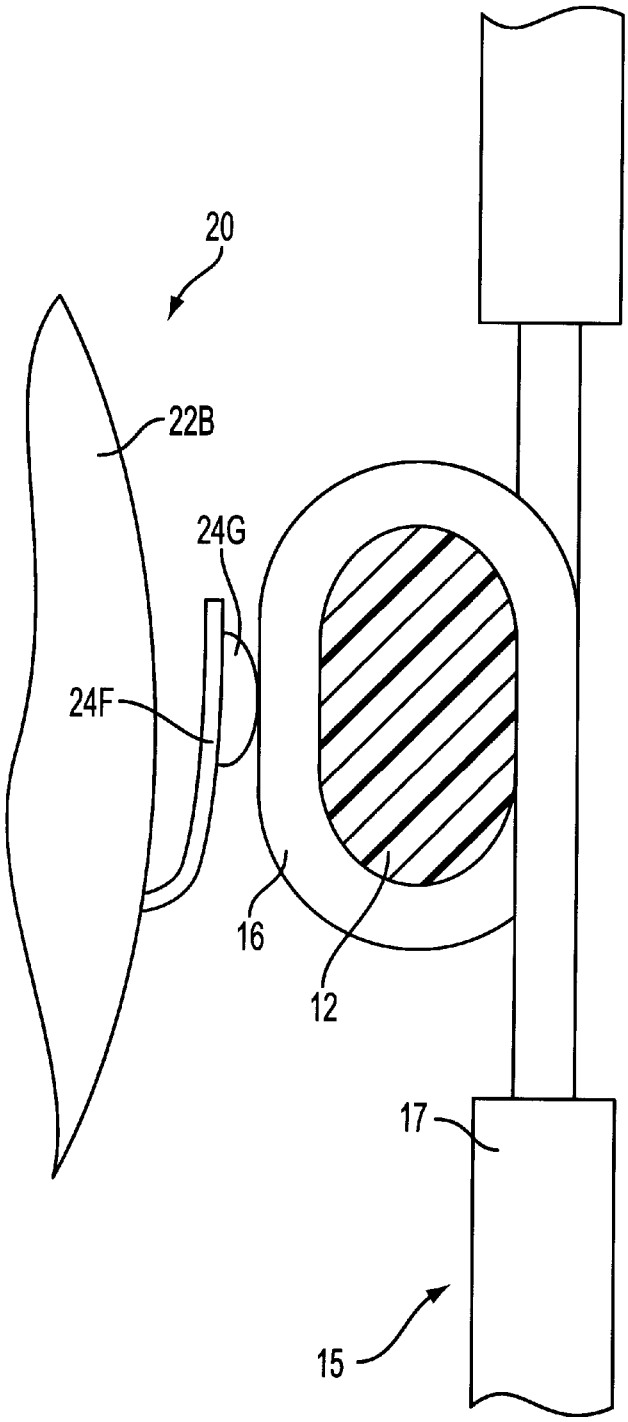
FIG. 11 is a partial, enlarged rear face view of the embodiment of FIG. 8 showing contact portions of a bulb socket and an electric wire.

A second embodiment of the present invention is explained below with the aid of FIGS. 8 to 10. Similar parts of the fourth embodiment are given the same reference numeral. A body 10 has an attachment hole 11, a bulb socket 20 being attached by being passed wherethrough. Four ribs 42 protrude from a posterior face of the body 10 (the side face in FIG. 1, and the face shown in FIG. 2), the ribs 42 protruding at a location slightly separated from an edge of the attachment hole 11. The four ribs 42 are provided at a 90° pitch along a circular path concentric with the attachment hole 11. Each rib 42 protrudes in an elliptic cylindrical shape, the length-wise axis thereof being parallel to the direction of the attachment hole 11. Further, a pair of stopping members 43 are formed on the protruding edge of the rib 42, these stopping members 43 extending towards the outer circumference from the parallel edges of the ribs 42.

The rib 42 is provides with an electric wire 45 distributed along the posterior face of the body 10. The electric wire 45 comprises a core wire 46 made from twisted metal filament and covered with a plastic covering 47. Along the distribution path of the electric wire 45 a specified length of the plastic covering 47 is removed, this length corresponding to the rib 42. The core wire 46 is thus exposed and is wound a number of times around the outer circumference of the rib 42, thus binding it thereto. Furthermore, the electric wire 45 is fitted together with grooves and hook members (not shown) provided on both sides of the rib 42, thereby maintaining the electric wire 45 tight, and preventing loosening of the core wire 46 wound around the rib 12. The stopping members 43 provided on the protruding edge of the rib 42 prevent the core wire 46 from coming off.

The bulb socket 20 comprises a plastic supporting member 21, a plastic fitting member 22 which fits together with a posterior portion of the supporting member 21, a bulb 23 with a wedge base, and a plurality of terminal fittings 24 as previously described. The terminal fitting 24 has electric wire contact members 24E which protrude towards the outer circumference from the base end of the tabs 24B. Furthermore, the electric wire contact members 24E pass through a space between the fitted-together supporting member 21 and the fitting member 22 and protrude towards the outer circumference of a flange 22B as illustrated. The portion which protrudes from the flange 22B constitutes contact members 24F which make contact with the electric wire 45. These contact members 24F, which are resiliently bendable, are provided at a pitch of 90° in the circumferential direction and, seen from the posterior face, extend in a cantilevered fashion in an anti-clock direction. Further, the distance from the axis of the bulb socket 20 to the tips of protrusion 24G of the contact members 24F is slightly greater than the distance from the centre of the attachment hole 11 to the core wire 46 wound around the rib 43.

The bulb socket 20 is attached to the body 10 in conventional manner, i.e. by bayonet fitting As the bulb socket 20 is being rotated, the contact members 24F make resilient contact with the inner circumference of the core wire 46 and, when the bulb socket 20 is maintained in a fixed position, the tips of the protrusions 24G make contact with the core wire 46. The force due to the resilient recovery of the contact members 24F maintains a fixed contact pressure between the protrusions 24G and the core wire 46F.

When the bulb socket 20 and the electric wire 45 make contact in the embodiment described above, the contact members 24G make direct contact with the core wire 46. As a result, there is no need for connecting terminals to intervene between the bulb socket and the electric wire, as in the prior example, and the number of components is thus decreased.

Further, the contact portions of the electric wire 45 and the bulb socket 20 are in closer contact than in the conventional example to the extent that no connecting terminals intervene between the electric wire 45 and the bulb socket 20. As a result, extra space is gained around the bulb socket 20, and consequently there is a greater degree of freedom of design regarding the location of the bulb socket 20 and the positioning of the electric wire 45.

Moreover, the core wire 46 is wound a number of times around the rib 42, thereby binding it firmly to the body 10. As a result, even if a pulling force is exerted on the electric wire 45 in an axial direction, the core wire 46 does not become loose, nor does it shift and cause the plastic covering 47 to make contact with the contact members 24F. Consequently, the reliability of the connection with the bulb socket 20 is improved.

Further, the stopping members 43 are formed on the protruding edge of the rib 42. As a result, the core wire 46 will not come off the rib 42 even if a pushing or pulling force is exerted on the electric wire 45 in the direction of the protruding edge of the rib 42. The reliability of the connection with the bulb socket 20 is thus improved.

The present invention is not limited to the embodiments described above with the aid of figures. For example, the possibilities described below also lie within the technical range of the present invention. In addition, the present invention may be embodies in various other ways without deviating from the scope thereof.

(1) In the first embodiment described above, the core wire receiving member was groove-shaped. However, according to the present invention, the core wire receiving member may also be flat.

(2) In the first embodiment described above, a pair of supporting members are provided on both sides of the core wire receiving member. However, according to the present invention, a single supporting member may also be located on either one of the sides of the core wire receiving member.

(3) In the first embodiment described above, the inner faces of the supporting members are provided with an indenting member. However, according to the present invention, it is equally possible to have no indenting members and instead have flat faces clamping the electric wire.

(4) In the first embodiment described above, the supporting members, located adjacent to the core wire receiving member, regulate the movement of the electric wire. However, according to the present invention, it is equally possible to have no supporting members in the vicinity of the core wire receiving member, and to use other means to position the core wire in the core wire receiving member.

(5) In the first embodiment described above, the direction in which the electric wire is fitted to the supporting members is the same as the direction of attachment of the bulb socket. However, according to the present invention, it is equally possible to fit the electric wire to the supporting members in a sideways direction with respect to the direction of attachment of the bulb socket.

(6) In the first embodiment described above, the electric wire is merely fitted together with the supporting members. However, according to the present invention, a stopping protrusion may be provided on the inner face of the supporting members to prevent wire fitted therein from being separated.

(7) In the second embodiment described above, the core wire was fixed by being wound around the ribs. However, according to the present invention, the core wire may also be fixed to the plate, this being done by extending the core wire along the side face of the plate and fixing the two portions that make contact with the bulb socket to the plate.

(8) In the second embodiment described above, the contact members of the bulb socket are located on the outer circumference face of the flange. However, according to the present invention, the contact members may also be located on the edge face of the flange of the bulb socket.

(9) In both embodiments described above, the explanation refers to a connecting means having four terminals.

However, the present invention is equally suitable for a connecting means having three or less terminals, or having five or more terminals.

(10) In the second embodiment described above, the stopping means for the core wire is a stopping member having an enlarged diameter. However, according to the present invention, it is equally possible, for example, to provide grooves on the face of the rib located opposite the bulb socket and to fit the core wire into these grooves.

(11) In both embodiments described above, the bulb socket is attached to the body by being rotated. However, the present invention can be applied to cases where the bulb socket is attached without rotation.

(12) In the second embodiment described above, the ribs and the body are formed in a unified manner. However, according to the present invention, it is possible to attach them after forming the ribs and the body separately. In this case, the material for the ribs is not limited to plastic, they may equally well be made from metal.

What is claimed is:

1. An electrical connecting structure comprising a body having an aperture and an insulated electric wire having an exposed portion with the insulation absent, a bulb socket inserted into said aperture of the body and secured therein by rotation of the bulb socket, said bulb socket having an electrical contact which is placed in direct contact with said exposed portion of the wire upon rotation of said bulb socket in said body, and a projection on said body around which said exposed portion is wound to locate said exposed portion of said wire.

2. A structure according to claim 1 wherein said projection has a transversely extending member at the end thereof, said member retaining said exposed portion against movement of said exposed portion in the direction of the projection thereof.

3. An electrical connecting structure comprising a body having an aperture and an insulated electric wire having an exposed portion with the insulation absent, a bulb socket inserted into said aperture of the body and secured therein by rotation of the bulb socket, said bulb socket having an electrical contact which is placed in direct contact with said exposed portion of the wire upon rotation of said bulb socket in said body, and wire retaining means for engagement with said wire on both sides of said exposed portion.

4. A structure according to claim 3 wherein said guide has an open channel in which said exposed portion lays.

5. A structure according to claim 3 wherein said retaining means is adapted to indent said wire.

6. A structure according to claim 3 wherein said retaining means is adapted to indent said wire.

7. A structure according to claim 3 wherein said exposed portion of the wire is supported on one side and uncovered on another side facing the direction of insertion of said bulb socket in the aperture.

8. A structure according to claim 7 wherein said exposed portion of the wire is located by a guide on said body.

9. A structure according to claim 8 wherein said guide has an open channel in which said exposed portion lays.

10. A structure according to claim 8 wherein said guide is a projection around which said exposed portion is wound.

11. A structure according to claim 10 wherein said projection has a transversely extending member at the end thereof, said member retaining said exposed portion against movement of said exposed portion in the direction of the projection thereof.

* * * * *